US010631653B2

(12) United States Patent
Beck et al.

(10) Patent No.: US 10,631,653 B2
(45) Date of Patent: Apr. 28, 2020

(54) MOTORIZED SOFA BED

(71) Applicant: L&P Property Management Company, South Gate, CA (US)

(72) Inventors: Daniel J. Beck, Carthage, MO (US); Richard L. McCune, Carthage, MO (US); Gregory T. Koehler, Joplin, MO (US); William B. York, Jr., Carthage, MO (US); Franklin H. Rawlings, Carthage, MO (US)

(73) Assignee: L&P Property Management Company, South Gate, CA (US)

( * ) Notice: Subject to any disclaimer, the term of this patent is extended or adjusted under 35 U.S.C. 154(b) by 235 days.

(21) Appl. No.: 15/952,272

(22) Filed: Apr. 13, 2018

(65) Prior Publication Data

US 2019/0313805 A1 Oct. 17, 2019

(51) Int. Cl.

| | |
|---|---|
| ***A47C 17/175*** | (2006.01) |
| ***A47C 4/02*** | (2006.01) |
| ***A47C 17/16*** | (2006.01) |
| ***A47C 1/024*** | (2006.01) |

(52) U.S. Cl.

CPC ..... *A47C 17/1756* (2013.01); *A47C 1/0242* (2013.01); *A47C 4/028* (2013.01); *A47C 17/16* (2013.01)

(58) Field of Classification Search

CPC . A47C 17/1756; A47C 17/175; A47C 1/0242; A47C 4/028; A47C 1/03211; A47C 17/16; A47C 17/162; A47C 20/041

See application file for complete search history.

(56) References Cited

U.S. PATENT DOCUMENTS

| | | | | |
|---|---|---|---|---|
| 3,028,607 | A | 4/1962 | Anderson | |
| 3,657,747 | A * | 4/1972 | Rogers, Jr. | A47C 17/1756 5/29 |
| 3,747,135 | A * | 7/1973 | Barabas | A47C 17/1756 5/13 |
| 4,365,836 | A * | 12/1982 | Jackson | A47C 1/03211 297/330 |
| 4,563,784 | A * | 1/1986 | Shrock | A47C 17/17 297/342 |
| 4,756,034 | A | 7/1988 | Stewart | |
| 4,937,900 | A * | 7/1990 | Bridges | A47C 1/0342 297/330 |
| 5,195,194 | A * | 3/1993 | Bradley | A47C 17/161 5/37.1 |
| 8,196,236 | B2 | 6/2012 | Smythe | |
| 8,464,370 | B2 | 6/2013 | Beck et al. | |
| 2006/0096027 | A1 | 5/2006 | Thurow | |

* cited by examiner

*Primary Examiner* — Robert G Santos
*Assistant Examiner* — Alison N Labarge
(74) *Attorney, Agent, or Firm* — Wood, Herron & Evans, LLP

(57) ABSTRACT

A motorized furniture assembly having seat and back support sections moves between sofa and bed positions relative to a stationary frame by activation of two motorized drive assemblies. The motorized drive assemblies move seat support brackets of a seat section forward and backward relative to the stationary frame. Movement of the seat section moves a back support section between horizontal and raised positions. Two linkage assemblies control movement of the motorized furniture assembly between the sofa and bed positions upon actuation of said at least one actuator for activating the motorized drive assemblies.

18 Claims, 13 Drawing Sheets

MOTORIZED SOFA BED

TECHNICAL FIELD

The present invention relates generally to motorized sofa beds and to kits which may convert a stationary furniture piece into a motorized sofa bed.

BACKGROUND

Numerous seating devices have been known to convert to a bed. However, the linkage mechanisms used for such conversion typically are large, heavy and cumbersome to use. The conversion is usually done manually and often requires a strong individual to perform the manual conversion.

Accordingly, there is a need for a motorized sofa bed which uses a simple linkage mechanism which may be activated quickly and easily.

There is further a need for a kit which may be shipped to a furniture manufacturer customer to convert a stationary seating furniture piece into a motorized sofa bed.

SUMMARY

According to one aspect of the invention, a motorized furniture assembly movable between a sofa position and a bed position comprises a stationary frame having two sides, and seat and back support sections movable relative to the stationary frame. The seat section comprises two seat support brackets and a seat deck extending between the seat support brackets. The back support section comprises back deck support brackets and a back deck extending between the back deck support brackets.

The motorized furniture assembly further comprises a power assembly for moving the furniture assembly between the sofa and bed positions. The power assembly comprises a power supply, a controller and at least one actuator.

The motorized furniture assembly further comprises two control assemblies, each control assembly including a motorized drive assembly and a linkage assembly joined to the motorized drive assembly for controlling movement of the seat and back support sections relative to the stationary frame. Each of the motorized drive assemblies comprises a rotatable screw drive used to move a shuttle forward and backward relative to the stationary frame.

The motorized furniture assembly further comprises a universal bracket attached to each of the shuttles of each of the motorized drive assemblies. Each of the universal brackets is secured to one of the seat support brackets such that movement of the shuttles moves the seat support brackets of the seat section which moves the back deck support brackets of the back support section.

The motorized furniture assembly further comprises two stationary mounting assemblies, one of the stationary mounting assemblies being secured to each side of the stationary frame. One of the two motorized drive assemblies is mounted to one of the stationary mounting assemblies.

The motorized furniture assembly further comprises two linkage assemblies for controlling movement of the furniture assembly between the sofa and bed positions upon actuation of said at least one actuator. Each of the linkage assemblies comprises a strong arm having a first end and a second end. The first end of the strong arm is pivotally connected to one of the seat support brackets and the second end of the strong arm is pivotally connected to one of the stationary mounting assemblies. Movement of the shuttles of the motorized drive assemblies moves the seat section between forward and rearward positions which causes movement of the back support section between horizontal and raised positions.

Each of the linkage assemblies comprises a front arm having a first end and a second end. The first end of the front arm is pivotally connected to one of the stationary mounting assemblies. Each of the linkage assemblies further comprises an L-shaped arm having a first end and a second end. The first end of the L-shaped arm is pivotally connected to the second end of the front arm and the second end of the L-shaped arm is pivotally connected to one of the seat frame supports. Each of the linkage assemblies further comprises a connector arm having a first end and a second end. The first end of the connector arm is pivotally connected to the second end of the front arm and the first end of the L-shaped arm. Each of the linkage assemblies further comprises a swivel arm having an upper end and a lower end. The upper end of the swivel arm is pivotally connected to one of the stationary mounting assemblies and the lower end of the swivel arm is pivotally connected to the second end of the connector arm. Each of the linkage assemblies further comprises an intermediate arm having a front end and a rear end. The rear end of the intermediate arm is pivotally connected to the swivel arm between the upper and lower ends of the swivel arm. Each of the linkage assemblies further comprises a teeter arm having a front end and a rear end. The front end of the teeter arm is pivotally connected to the front end of the intermediate arm. Each of the linkage assemblies further comprises a rear arm having an upper end and a lower end. The upper end of the rear arm is pivotally connected to one of the seat support brackets and the lower end of the rear arm is pivotally connected to the second end of the connector arm. Each of the linkage assemblies further comprises an outer arm having a front end and a rear end. The front end of the outer arm is pivotally connected to the rear end of the teeter arm and the rear end of the outer arm is pivotally connected to the rear arm between the upper and lower ends of the rear arm.

According to another aspect of the invention, a kit comprising the components of the motorized furniture assembly are packed in a container for shipping to a furniture manufacturer customer. The components are pre-assembled and ready to mount to a stationary sofa frame to convert the stationary sofa frame to a motorized sofa bed quickly and easily.

The shippable conversion kit comprises a power supply, a controller, at least one actuator, and two control assemblies including a left hand control assembly and a right-hand control assembly. Each control assembly comprises a stationary mounting assembly, a motorized drive assembly secured to the stationary mounting assembly and a linkage assembly secured to the stationary mounting assembly for controlling movement of the furniture assembly between the sofa and bed positions upon actuation of said at least one actuator. Each control assembly includes a seat deck support bracket and a back deck support bracket pivotally secured to the seat deck support bracket. Each linkage assembly comprises the components described herein.

Various additional features and advantages of the invention will become more apparent to those of ordinary skill in the art upon review of the following detailed description of the illustrative embodiments taken in conjunction with the accompanying drawings.

BRIEF DESCRIPTION OF THE DRAWINGS

The drawings, which are incorporated in and constitute a part of this specification, illustrate embodiments of the invention and, together with the general description given above and the detailed description given below, explain the embodiments of the invention.

DETAILED DESCRIPTION

Figure 1:
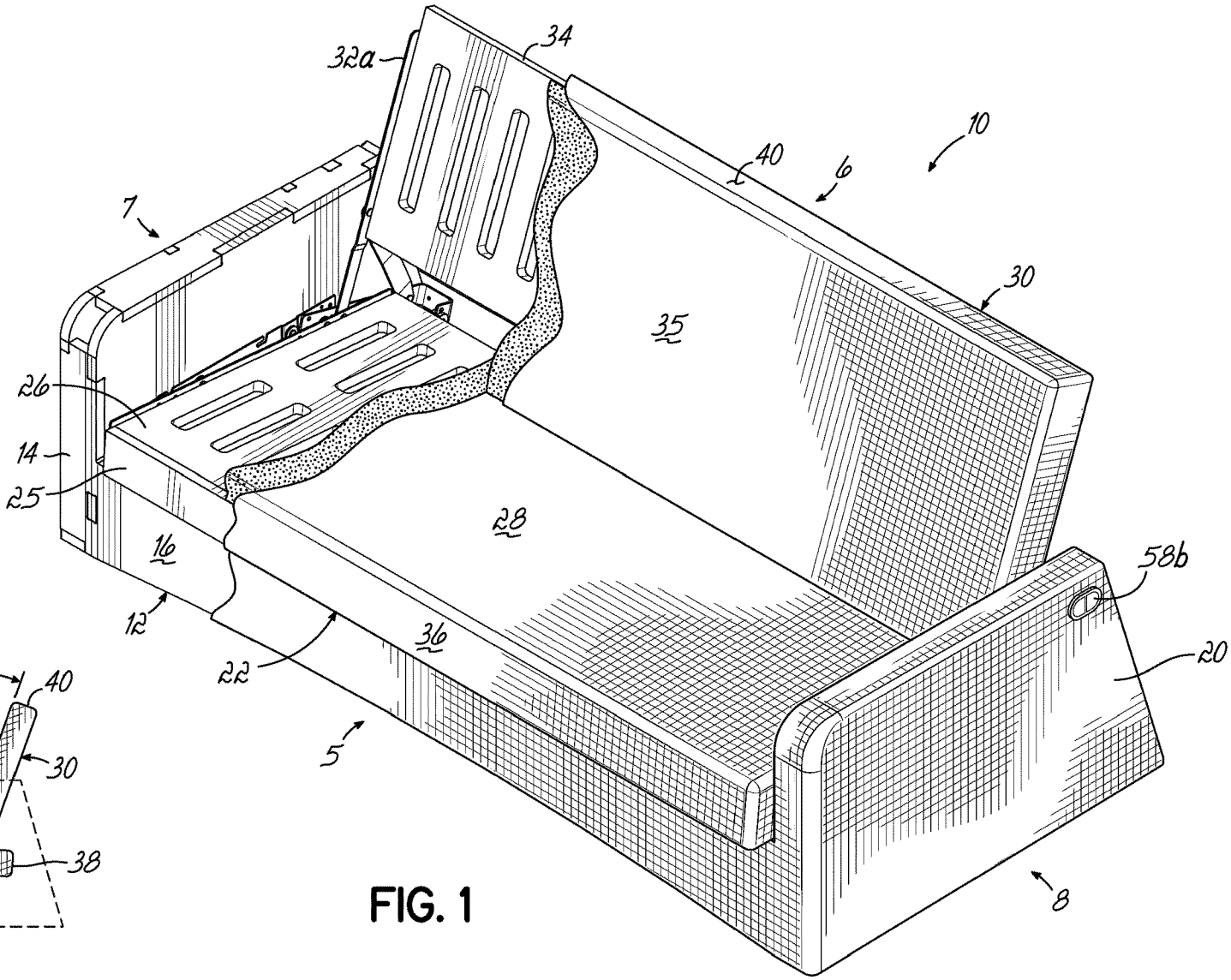
FIG. 1 is a perspective view of a motorized furniture assembly partially covered with a cover in the seat position.
Figure 1A:
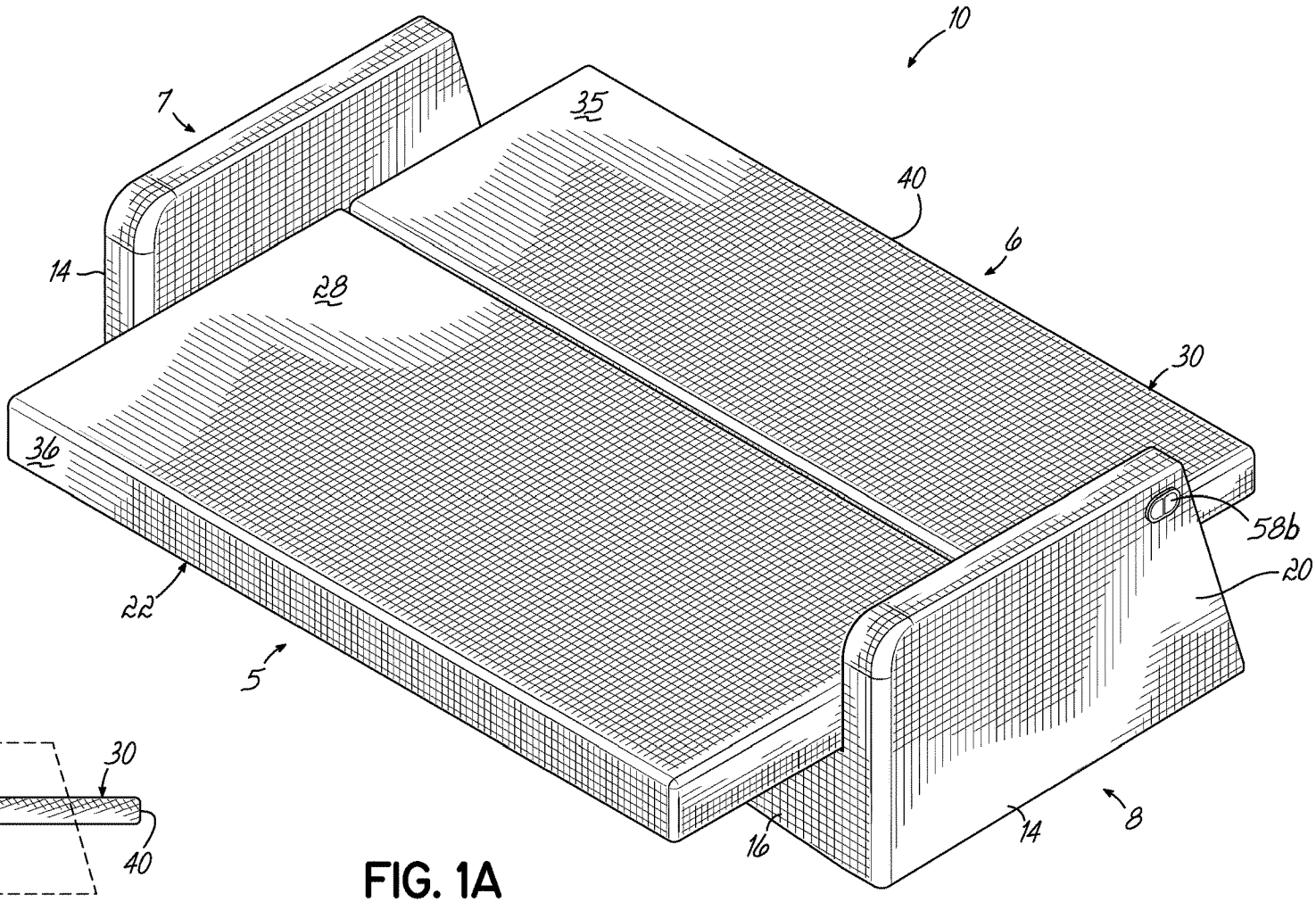
FIG. 1A is a perspective view of a motorized furniture assembly partially covered with a cover in the bed position.
Figure 1C:
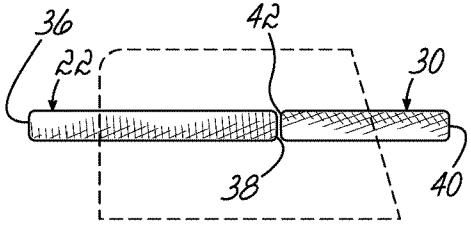
FIG. 1C is a side view of a motorized furniture assembly in the bed position showing the positions of the seat and back support sections.
Figure 2:
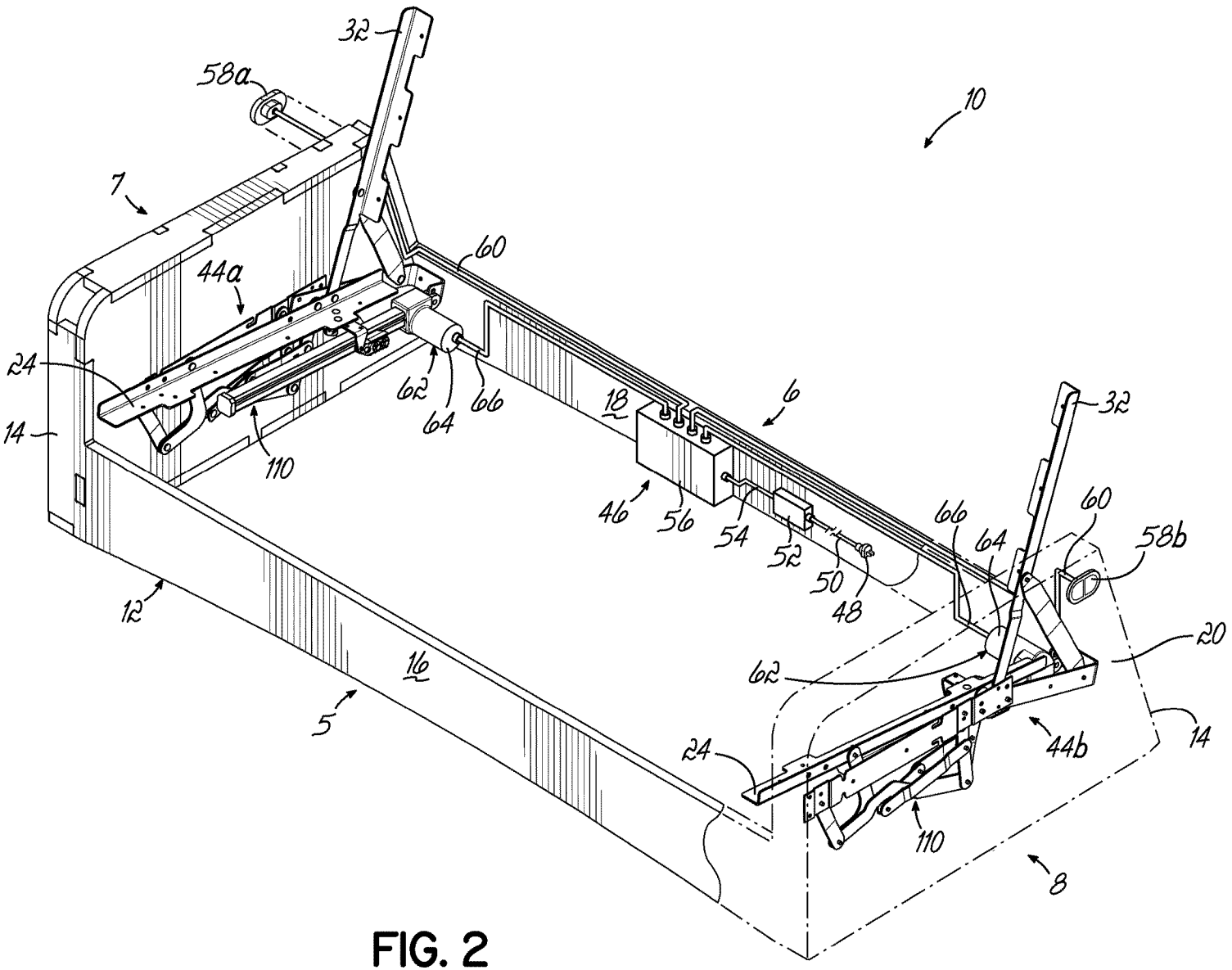
FIG. 2 is a perspective view of the motorized furniture assembly of FIG. 1 in the seat position without the cover and seat and back decks.
Figure 2A:
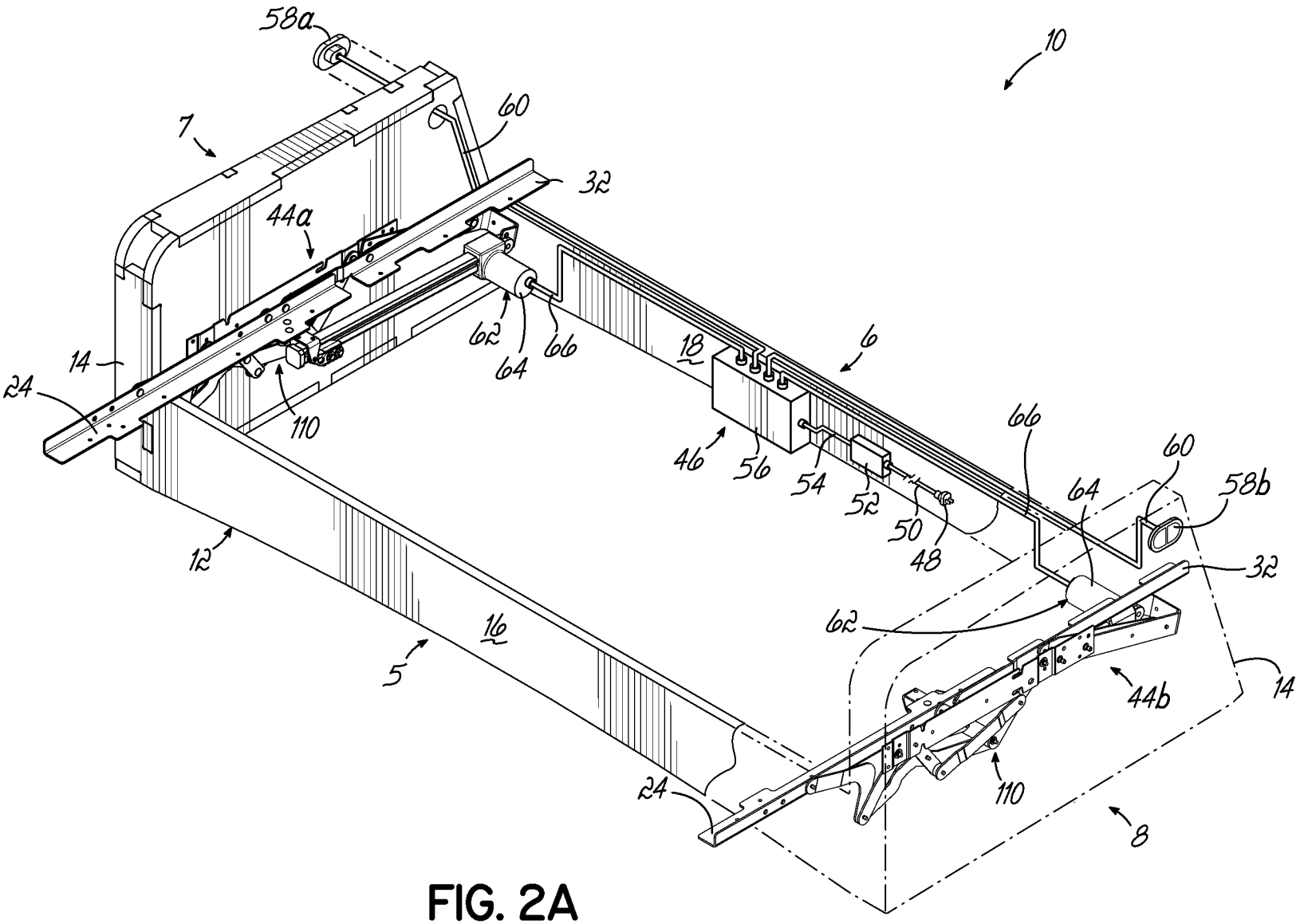
FIG. 2A is a perspective view of the motorized furniture assembly of FIG. 1 in the bed position without the cover and seat and back decks.

Referring to FIG. 1, a motorized furniture assembly 10 is shown. FIGS. 1 and 2 show the motorized furniture assembly 10 in a sofa position. FIGS. 1A and 2A show the motorized furniture assembly 10 in a bed position. For purposes of this document, referring to FIGS. 1 and 1A, the front is indicated by reference 5, the rear indicated by reference 6, the left indicated by reference 7 and the right indicated by reference 8.

As best shown in FIG. 2, the motorized furniture assembly 10 comprises a stationary frame 12 having sides 14, a front panel 16 extending between sides 14 and a rear panel 18 extending between sides 14. FIGS. 1 and 1A illustrate the stationary frame 12 being partially covered with a cover 20. Although one configuration of stationary frame 12 is illustrated, the drawings are not intended to limit the type or configuration of stationary frame 12.

As shown in FIGS. 1 and 1A, the motorized furniture assembly 10 further comprises a seat section 22 movable relative to the stationary frame 12 between a rear position shown in FIG. 1 and a forward position shown in FIG. 1A. The seat section 22 comprises left and right seat deck support brackets 24 along with a seat deck 26 extending therebetween. As shown in FIGS. 1 and 1A, a seat deck front 25 extends downwardly from the seat deck 26 and extending between front ends of the seat deck support brackets 24. As shown in the drawings, each of the seat deck support brackets 24 is generally L-shaped in cross-section, having a vertical flange 130 and a horizontal flange 131 to which the seat deck 26 is secured.

For simplicity, the components on the left side of the motorized furniture assembly 10 will be referenced by an "a" while the same components on the right side of the motorized furniture assembly 10 will be referenced by a "b". Although one configuration of seat deck 26 is illustrated, any other configuration of seat deck may be used; the drawings are not intended to be limiting. Although one configuration of seat deck support bracket 24 is illustrated, any other configuration of seat support bracket may be used; the drawings are not intended to be limiting. As shown in FIGS. 1 and 1A, the seat section 22 has a cover 28.

As shown in FIGS. 1 and 1A, the motorized furniture assembly 10 further comprises a back support section 30 movable relative to the stationary frame 12 between a raised position shown in FIG. 1 and a dropped position shown in FIG. 1A. The back support section 30 comprises left and right back support brackets 32 along with a back deck 34 extending therebetween. As shown in the drawings, each of the back deck support brackets 32 is generally L-shaped in cross-section, having a flange 230 and a flange 232 to which the back deck 34 is secured. Although one configuration of back deck 34 is illustrated, any other configuration of back deck may be used; the drawings are not intended to be limiting. As shown in FIGS. 1 and 1A, the back support section 30 has a cover 35.

Figure 1B:
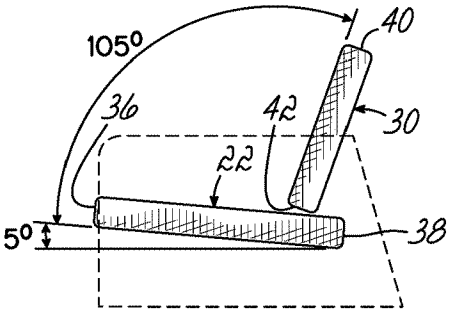
FIG. 1B is a side view of a motorized furniture assembly in the sofa position showing the positions of the seat and back support sections.

As shown in FIG. 1B, when the motorized furniture assembly 10 is in its sofa position, the seat section 22 is titled backward at an angle of five degrees so a front surface 36 of the seat section 22 is above the rear surface 38 of the seat section 22. Similarly, when the motorized furniture assembly 10 is in its sofa position, the back support section 30 is titled backward to create an angle of 105 degrees relative to the seat section 22, an upper surface 40 of the back support section 30 being behind the lower surface 42 of the back support section 30.

The motorized furniture assembly 10 is a wall hugger type of mechanism so that upon moving from its sofa position shown in FIG. 1 to its bed position shown in FIG. 1A, the seat section 22 moves forwardly and the front surface 36 of the seat section 22 rotates downwardly until the seat section 22 is in a horizontal flat position. Upon moving from its sofa position to its bed position, the back support section 30 moves forwardly and the upper surface 40 of the back support section 30 rotates downwardly until the back support section 30 is in a horizontal flat position parallel and behind the seat section 22, as shown in FIG. 1A.

Figure 3:
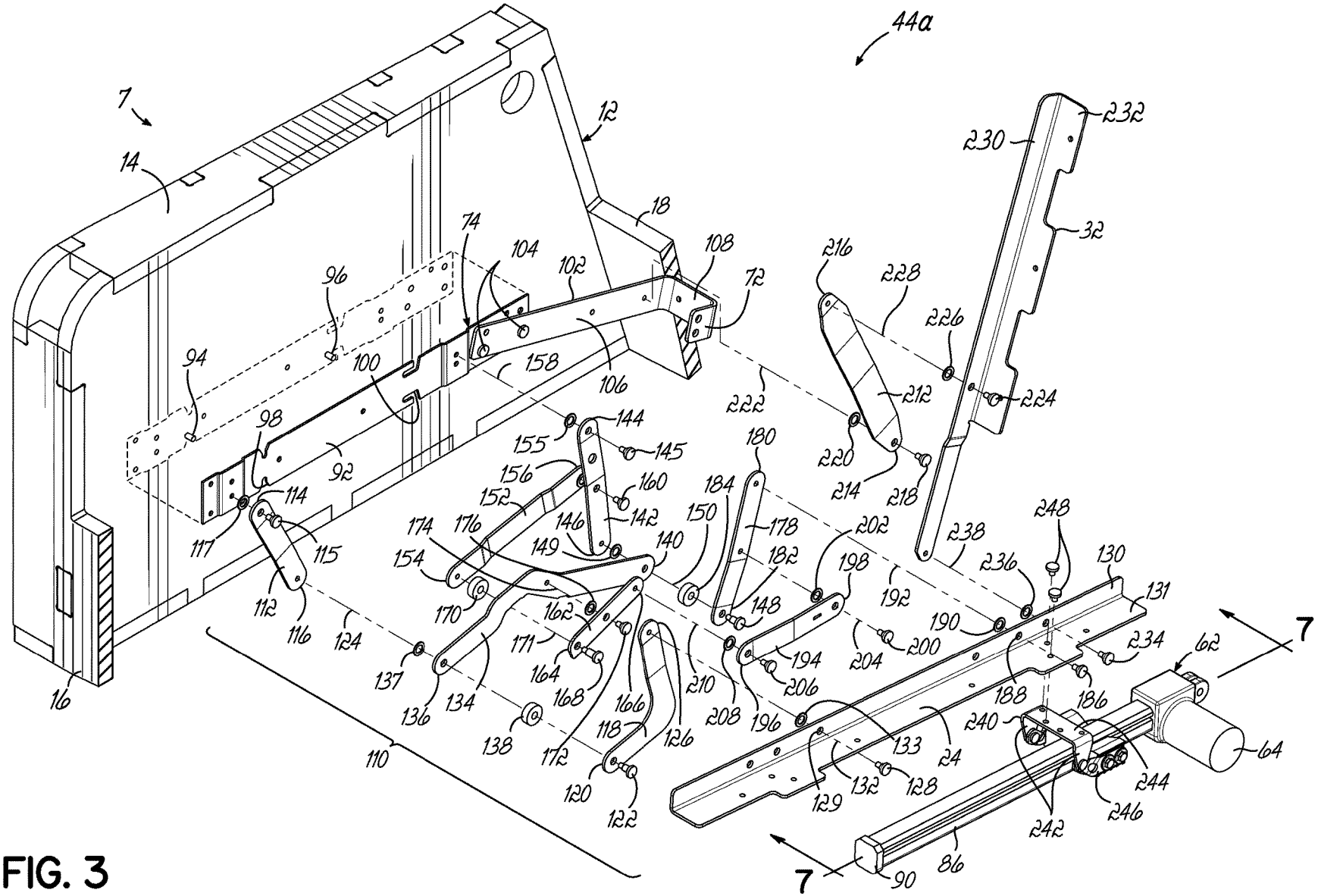
FIG. 3 is a disassembled perspective view of the left control assembly and the left side of the stationary frame.
Figure 4:
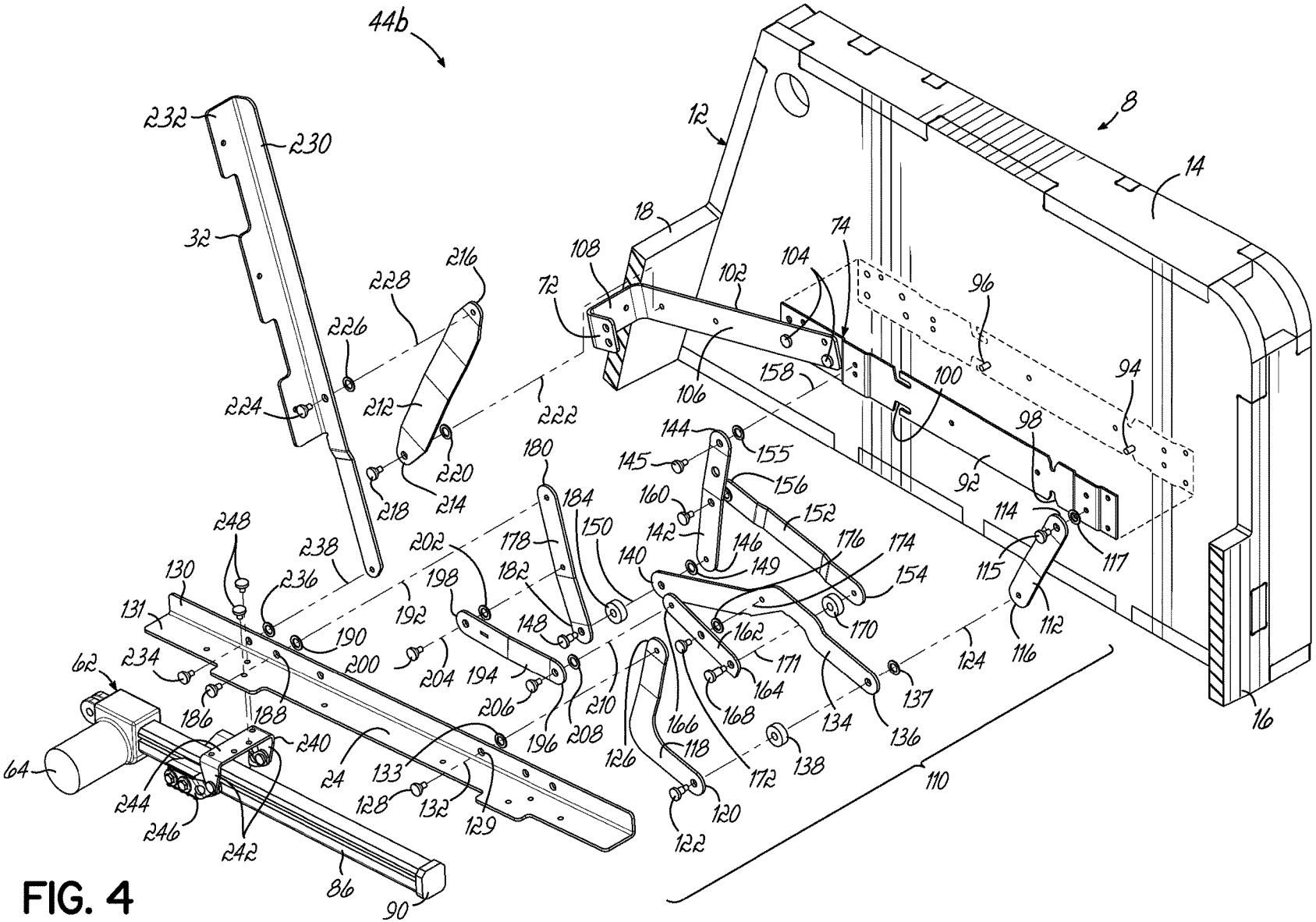
FIG. 4 is a disassembled perspective view of the right control assembly and the right side of the stationary frame.
Figure 5A:
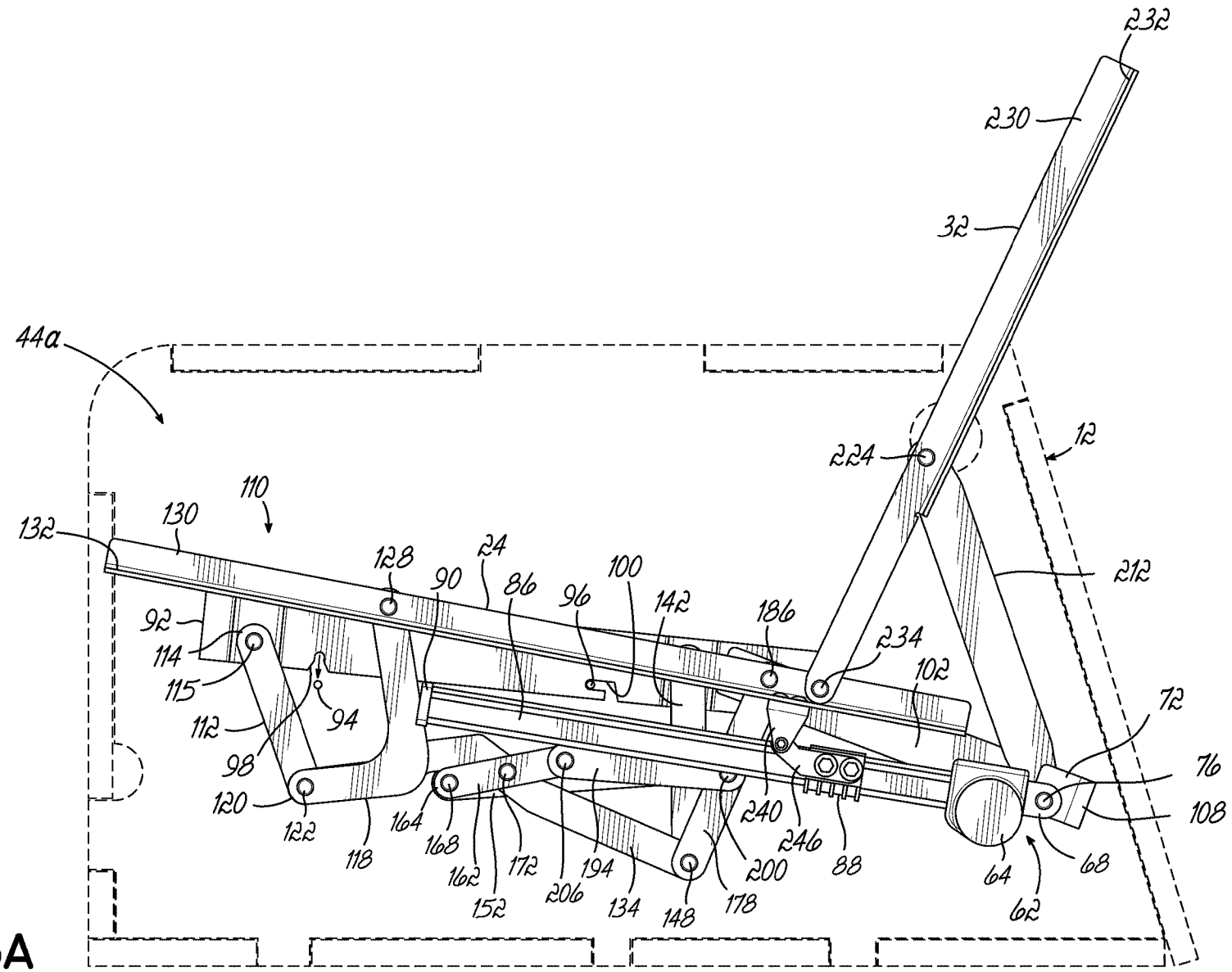
FIG. 5A is a side view of the left control assembly being secured to the left side of the stationary frame.
Figure 5B:
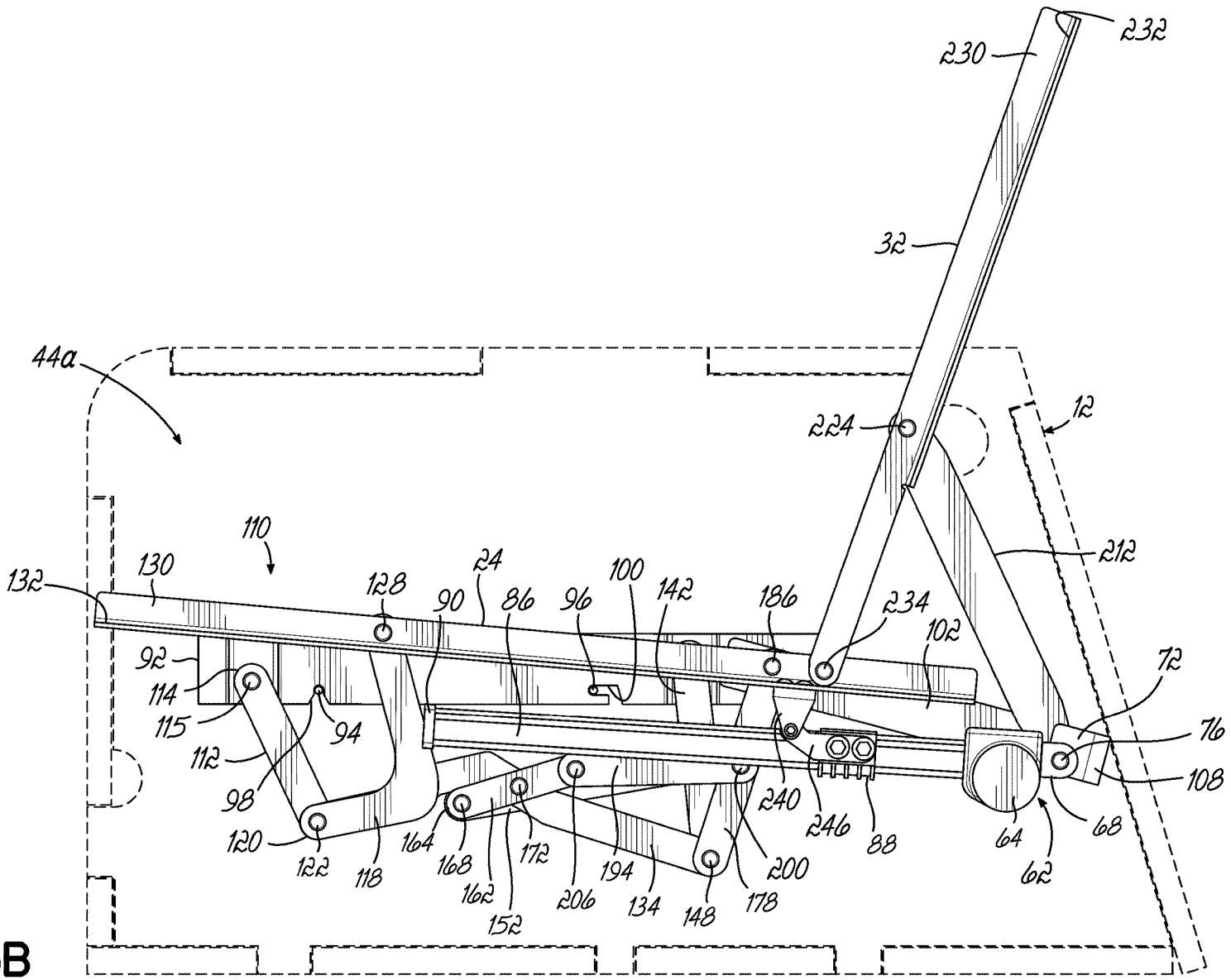
FIG. 5B is a side view of the left control assembly secured to the left side of the stationary frame in a sofa position.
Figure 6A:
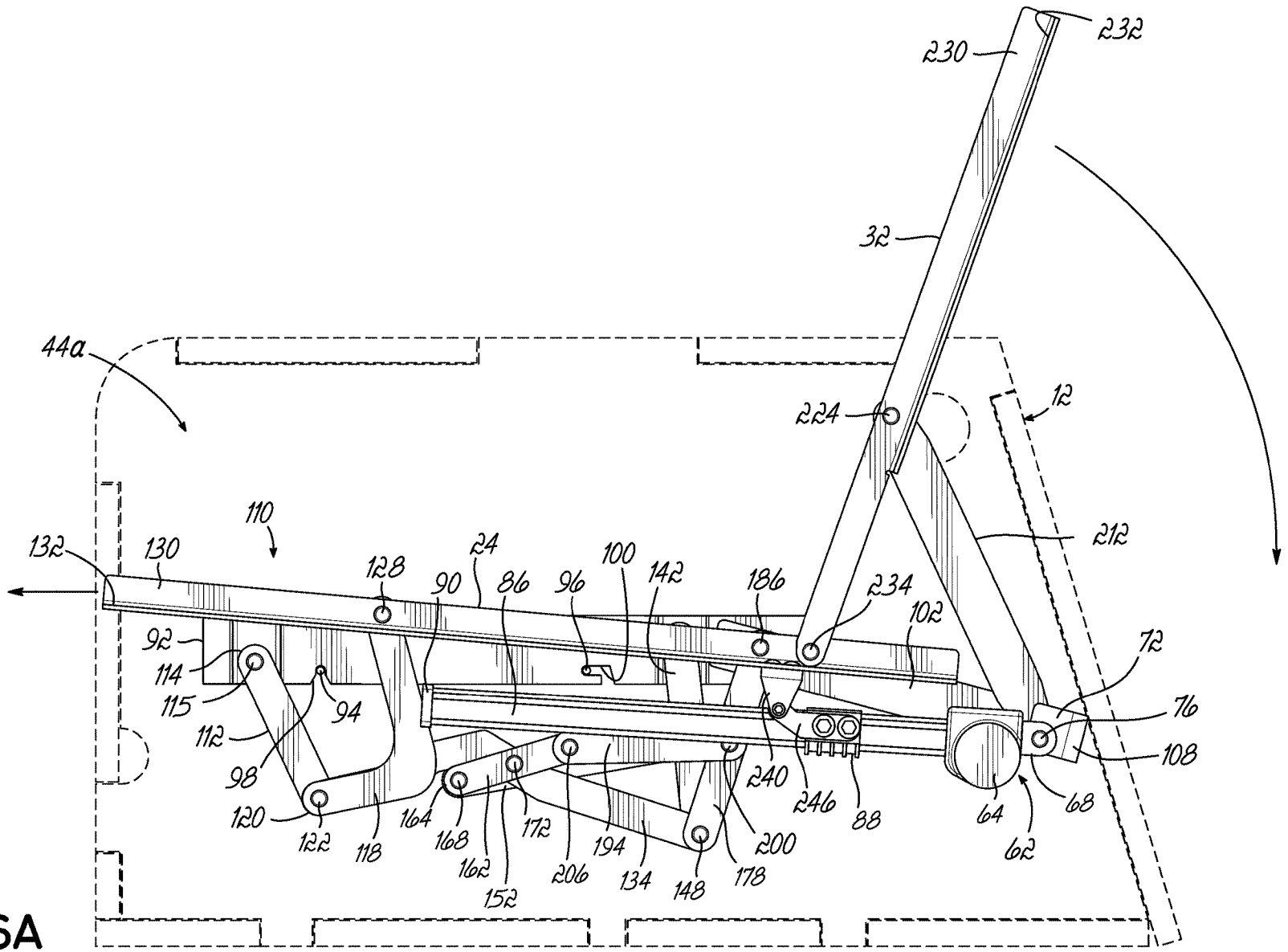
FIG. 6A is a side view of the left control assembly being moved from the sofa position into a bed position.
Figure 6B:
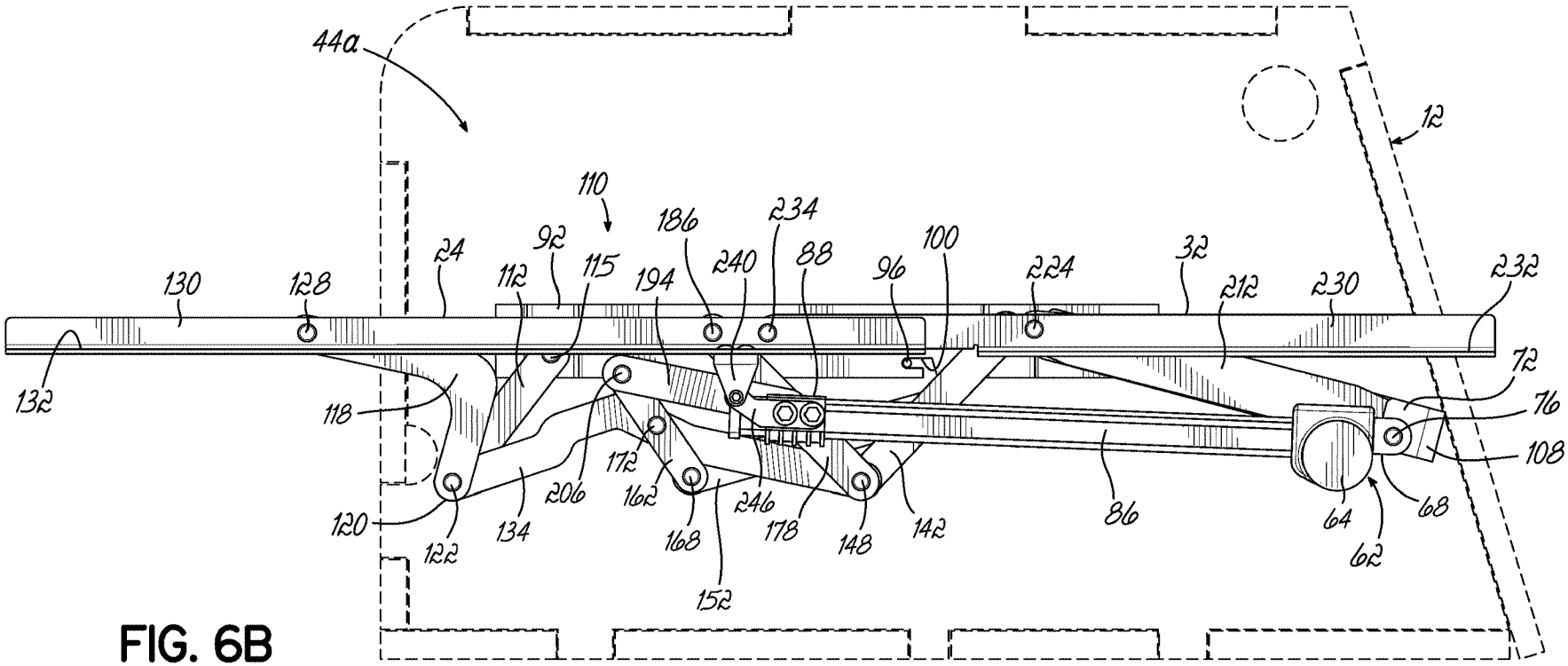
FIG. 6B is a side view of the left control assembly in the bed position.

FIGS. 2 and 2A illustrate a left control assembly 44*a* and a right control assembly 44*b* which are secured to the left and right sides 14, respectively, of the stationary frame 12 in a manner described below. The control assemblies 44*a*, 44*b* are powered by a power assembly 46. FIG. 3 illustrates the left control assembly 44*a* in a disassembled condition. FIG. 4 illustrates the right control assembly 44*b* in a disassembled condition.

As best shown in FIG. 2, the power assembly 46 comprises an outlet 48, a power cord 50 extending from the outlet 48 to a power supply 52, another section of cord 54 extending from the power supply 52 to a controller 56. The controller 56 is shown mounted inside the rear panel 18 of the stationary frame 12, but may be located at any other desired location. As best shown in FIG. 2, the power assembly 46 further comprises an actuator 58*a* located on the left side 14 of the stationary frame 12 and an actuator 58*b* located on the right side 14 of the stationary frame 12. Each actuator 58*a*, 58*b* is electrically coupled to controller 56 via a cord 60.

As best shown in FIGS. 2 and 2A, the left control assembly 44*a* and the right control assembly 44*b* each include a motorized drive assembly 62 including a motor 64 and a cord 66 which extends to the controller 56 to electrically couple the motorized drive assembly 62 to the controller 56. In this manner, the two motorized drive assemblies 62 may operate together in the same manner to move the seat and back support sections 22, 30 in the desired manner. Although each control assembly is illustrated having a motorized drive assembly, it is within the scope of the present invention that only one control assembly has a motorized drive assembly.

Figure 7:
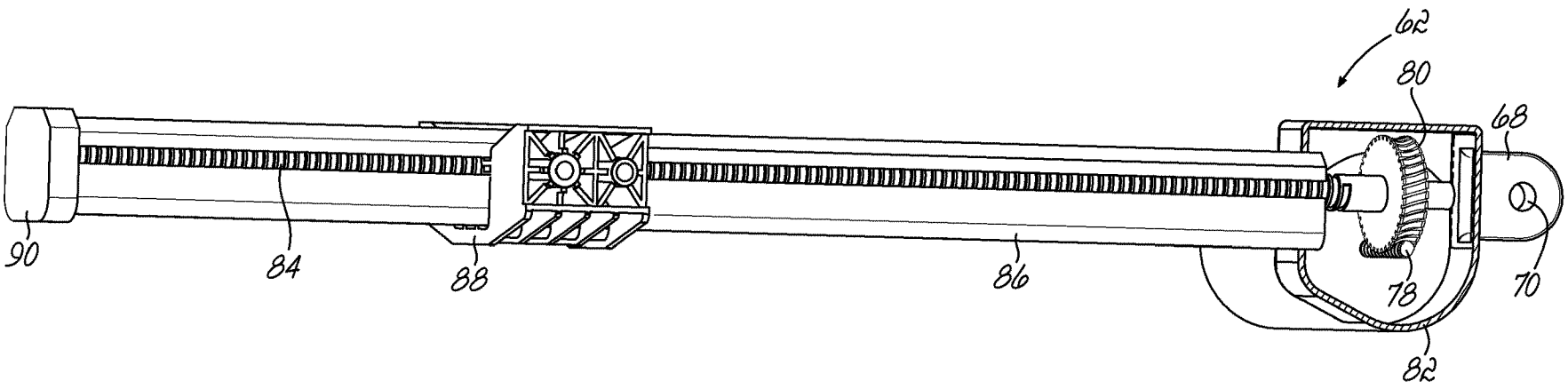
FIG. 7 is a schematic cross-sectional view of one of the motorized drive assemblies.

As shown in FIG. 7, each motorized drive assembly 62 has two mounting ears 68 having aligned openings 70 for securing the motorized drive assembly 62 to a flange 72 of a stationary mounting assembly 74 with a fastener 76, as shown in FIGS. 5A-6B and described below. Each motorized drive assembly 62 further comprises a driver 78 which rotates a drive gear 80 inside a motor housing 82. Rotation of the drive gear 80 rotates a threaded drive shaft 84 inside a shaft housing 86 which causes linear motion of a shuttle 88. A cap 90 is located at the end of the shaft housing 86.

Each of the left and right control assemblies 44*a*, 44*b* contain the same elements but oriented differently. Each of the elements is machined so that it may be used in either the left or right control assembly 44*a*, 44*b*.

Each control assembly 44*a*, 44*b* comprises a two-piece stationary mounting assembly 74. The unitary front or mounting piece 92 is shown in FIGS. 3 and 4 in solid separated from the stationary frame 12 and shown in dashed lines abutting one of the sides 14 of the stationary frame 12. As shown in FIGS. 3 and 4, each of the sides 14 of the stationary frame 12 has two spaced pins extending inwardly towards the center of the stationary frame 12, a front pin 94 and a rear pin 96. As shown in FIGS. 3 and 4, the front piece 92 of stationary mounting assembly 74 has a front notch 98 adapted to receive and retain the front pin 94 of the side 14 of the stationary frame 12 and a rear notch 100 adapted to receive and retain the rear pin 96 of the side 14 of the stationary frame 12. The spacing, location and size of the front and rear notches 98, 100, respectively, of the front piece 92 of stationary mounting assembly 74 locates the stationary mounting assembly 74 in its proper location for the control assembly to function properly. The front piece 92 of the stationary mounting assembly 74 is generally horizontal and may be secured to one of the sides 14 of the stationary frame 12 with conventional fasteners such as screws to further secure the location of the front piece 92 of the stationary mounting assembly 74.

The rear or motor mounting piece 102 of the stationary mounting assembly 74 is secured to the front or mounting piece 92 of the stationary mounting assembly 74 with rivets 104, as shown in FIGS. 3 and 4. The motor mounting piece 102 of the stationary mounting assembly 74 is a unitary member comprising a long portion 106, an end portion 108 and a flange 72. The end portion 108 is generally perpendicular to the long portion 106 and the flange 72. The long portion 106 extends from back to front of the stationary frame 12 like the front piece 92 of the stationary mounting assembly 74. However, the motor mounting piece 102 of the stationary mounting assembly 74 is angled relative to the front piece 92 of the stationary mounting assembly 74 such that the end portion 108 is below the front piece 92 of the stationary mounting assembly 74. In other words, the motor mounting piece 102 of the stationary mounting assembly 74 is oriented downwardly as it extends rearwardly, as shown in the drawings.

Each control assembly 44*a*, 44*b* further comprises a linkage assembly 110 secured to the two-piece stationary mounting assembly 74 and secured to the motorized drive assemblies 62 for controlling movement of the seat and back support sections 22, 30, respectively. Although not numbered, each end of each of the links has an opening through which a rivet passes.

As best shown in FIGS. 3 and 4, moving generally from front to back, each linkage assembly 110 comprises a front arm 112 having a first end 114 and a second end 116. The first end 114 is pivotally secured with a rivet 115 to a front end of the front piece 92 of stationary mounting assembly 74. As shown in FIGS. 3 and 4, a shim 117 is located between the first end 114 of the front arm 112 and the front piece 92 of stationary mounting assembly 74.

Each linkage assembly 110 further comprises an L-shaped arm 118 having a first end 120 pivotally secured with a rivet 122 to the second end 116 of the front arm 112 to pivot about axis 124. The L-shaped arm 118 has a second end 126 pivotally secured with a rivet 128 to a vertical flange 130 of one of the seat deck support brackets 24 to pivot about axis 132. As shown in FIGS. 3 and 4, a shim 133 is located between the second end 126 of the L-shaped arm 118 and the vertical flange 130 of seat deck support bracket 24. The rivet 128 extends through an opening 129 in the vertical flange 130 of seat deck support bracket 24, through shim 133 and through the second end 126 of the L-shaped arm 118.

Each linkage assembly 110 further comprises a connector arm 134 having a first end 136 pivotally secured with rivet 122 to the second end 116 of the front arm 112 and to the first end 120 of the L-shaped arm 118. The first end 136 of connector arm 134 is between the second end 116 of the front arm 112 and the first end 120 of the L-shaped arm 118 and pivots about axis 124. As shown in FIGS. 3 and 4, a shim 137 is located between the second end 116 of the front arm 112 and the first end 136 of the connector arm 134. A bushing 138 is located between the first end 136 of the connector arm 134 and first end 120 of the L-shaped arm 118. The connector arm 134 has a second end 140.

Each linkage assembly 110 further comprises a swivel arm 142 having an upper end 144 and a lower end 146. The lower end 146 of the swivel arm 142 is pivotally secured with a rivet 148 to the second end 140 of the connector arm 134 to pivot about axis 150. The upper end 144 of the swivel arm 142 is pivotally secured with a rivet 145 to the front piece 92 of stationary mounting assembly 74 to pivot about axis 158. As shown in FIGS. 3 and 4, a shim 155 is located between the upper end 144 of the swivel arm 142 and the front piece 92 of stationary mounting assembly 74. As shown in FIGS. 3 and 4, a shim 149 is located between the second end 140 of the connector arm 134 and the lower end 146 of the swivel arm 142.

Each linkage assembly 110 further comprises an intermediate arm 152 having a front end 154 and a rear end 156. The rear end 156 of the intermediate arm 152 is pivotally secured with a rivet 160 to the swivel arm 142 between the upper and lower ends 144, 146 of the swivel arm 142.

Each linkage assembly 110 further comprises a teeter arm 162 having a front end 164 and a rear end 166. The front end 164 of the teeter arm 162 is pivotally secured with a rivet 168 to the front end 154 of the intermediate arm 152 underneath the connector arm 134 to pivot about axis 171. A bushing 170 is located between the front end 164 of the teeter arm 162 and the front end 154 of the intermediate arm 152. The teeter arm 162 is pivotally joined to a middle portion of the connector arm 134 via rivet 172 to pivot about axis 174. A shim 176 is located between the teeter arm 162 and the connector arm 134.

Each linkage assembly 110 further comprises a rear arm 178 having an upper end 180 and a lower end 182. Rivet 148 passes through the lower end 182 of the rear arm 178, through a bushing 184 located between the rear arm 178 and second end 140 of the connector arm 134, through the second end 140 of the connector arm 134, through shim 149 and through the lower end 146 of the swivel arm 142. The lower end 182 of the rear arm 178 pivots relative to the second end 140 of the connector arm 134 and relative to the middle of the rear arm 178 about axis 150. The upper end 180 of the rear arm 178 is pivotally secured to the vertical flange 130 of seat deck support bracket 24 with a rivet 186 which extends through an opening 188 in the vertical flange 130 of seat deck support bracket 24, through a shim 190 between the vertical flange 130 of seat deck support bracket 24 and the rear arm 178. The upper end 180 of the rear arm 178 pivots relative to the vertical flange 130 of seat deck support bracket 24 about axis 192.

Each linkage assembly 110 further comprises an outer arm 194 having a front end 196 and a rear end 198. Rivet 200 passes through the rear end 198 of the outer arm 194, through a shim 202 located between the outer arm 194 and the rear arm 178, through a middle portion of the rear arm 178. The rear end 198 of the outer arm 194 pivots relative to the rear arm 178 about axis 204. Similarly, another rivet 206 extends through the front end 196 of the outer arm 194, through shim 208, through a rear end 166 of the teeter arm 162. The front end 196 of the outer arm 194 pivots relative to the rear end 166 of the teeter arm 162 about axis 210.

Each linkage assembly 110 further comprises a strong arm 212 having a first end 214 and a second end 216. Rivet 218 passes through the first end 214 of the strong arm 212, through a shim 220 located between the strong arm 212 and the long portion 106 of the motor mounting piece 102 of the stationary mounting assembly 74. The first end 214 of the strong arm 212 pivots relative to the motor mounting piece 102 of the stationary mounting assembly 74 about axis 222.

Similarly, rivet 224 passes through flange 230 of one of the back deck support brackets 32, through a shim 226 located between the strong arm 212 and the back deck support bracket 32. The second end 216 of the strong arm 212 pivots relative to the back deck support bracket 32 about axis 228.

As best shown in FIGS. 3 and 4, the lower end of each back deck support bracket 32 is pivotally secured to vertical flange 130 of one of the seat deck support brackets 24 with a rivet 234. Rivet 234 passes through an opening in vertical flange 130 of one of the seat deck support brackets 24 and through a shim 236 located between the vertical flange 130 of seat deck support bracket 24 and the upper end 180 of the rear arm 178. The upper end 180 of the rear arm 178 pivots relative to the seat deck support bracket 24 about axis 238.

In order to begin movement of each linkage assembly 110, the motorized drive assemblies 62 must be activated by at least one actuator 58*a* or 58*b*. Upon being activated the shuttles 88 of the motorized drive assemblies 62 move linearly together which moves the seat section 22. Movement of the seat section 22 moves the back support section 30.

As best shown in FIGS. 3 and 4, each of the shuttles 88 of the motorized drive assemblies 62 is secured to one of the seat deck support brackets 24 with a generally U-shaped universal bracket 240 having two legs 242 and a top 244. A mounting bracket 246 is secured to each side of the shuttle 88. The legs 242 of the universal bracket 240 are secured to the mounting brackets 246. The top 244 of the mounting bracket 242 is secured to the horizontal flange 131 of one of the seat deck support brackets 24 with rivets 248.

Figure 8:
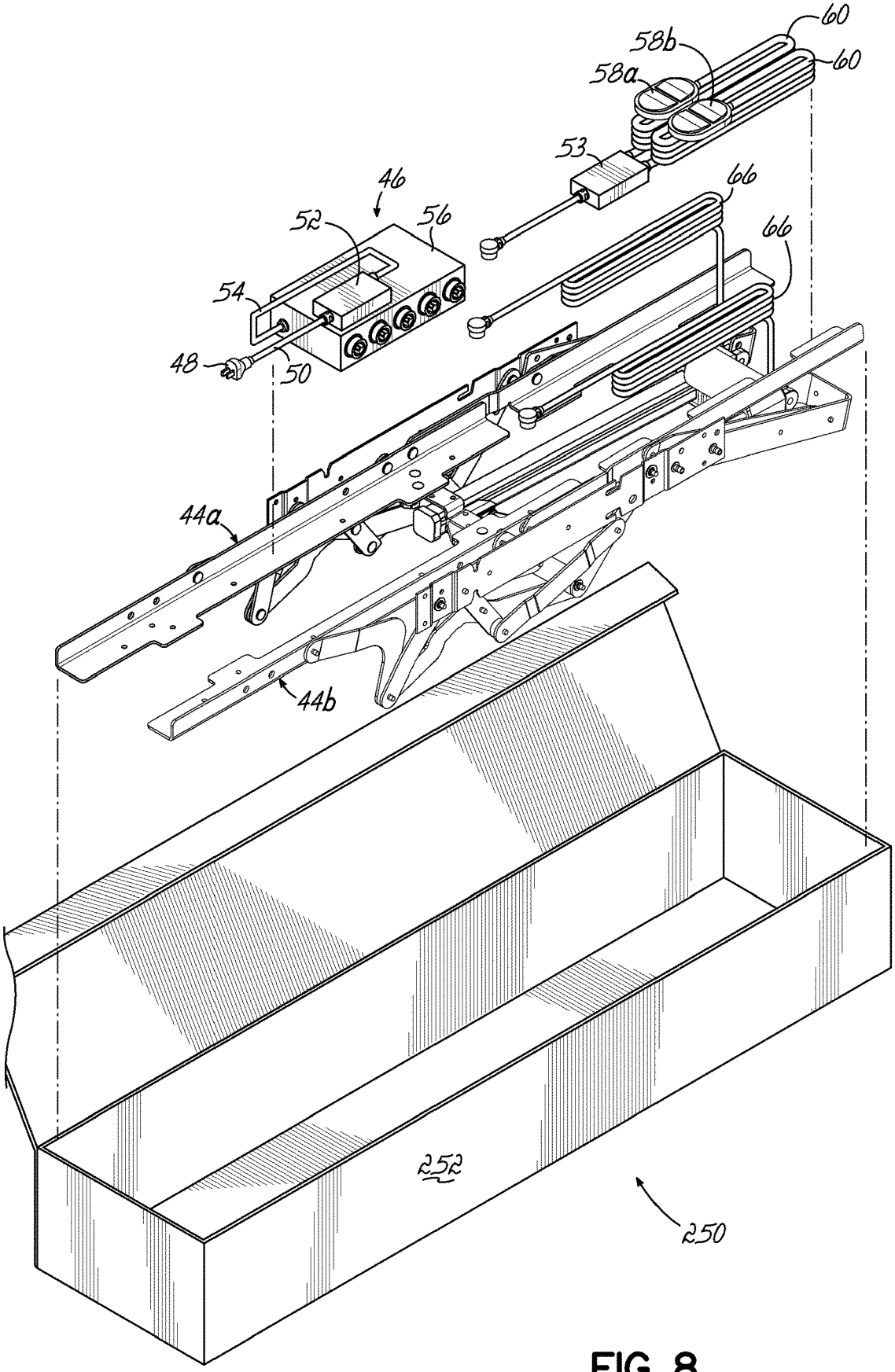
FIG. 8 is a perspective view of the kit of the present invention including a container.

FIG. 8 illustrates a kit 250 including a container 252 inside which all the components or parts of the present invention may fit to be shipped to a customer to convert a stationary furniture piece into a motorized sofa bed. The components include the left and right control assemblies 44*a*, 44*b* and the power assembly 46. The power assembly 46 includes the outlet 48, power cord 50, power supply 52, section of cord 54, controller 56 and at least one actuator 58 electrically coupled to another power supply 53. Although not shown, the actuator or actuators may be wireless and may be powered remotely.

Figure 9:
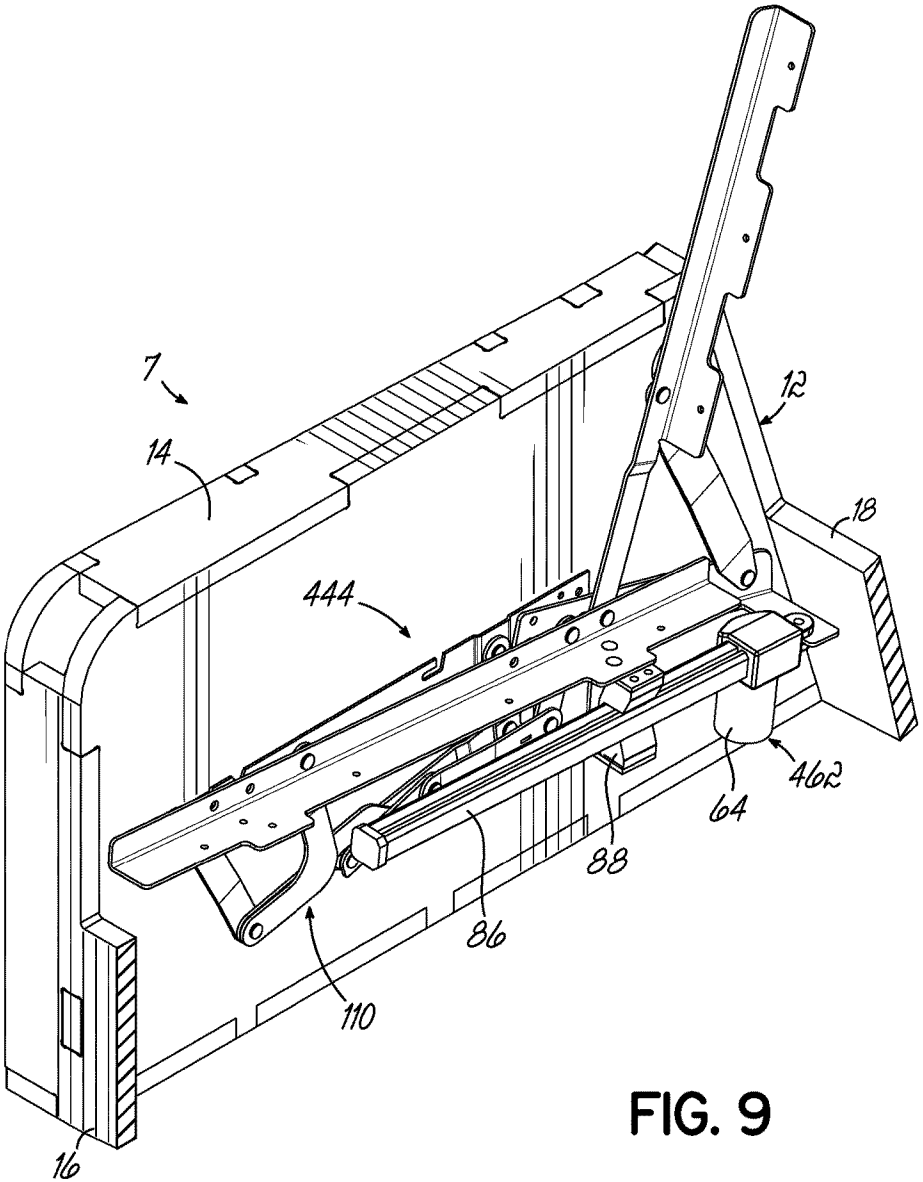
FIG. 9 is a perspective view of another left control assembly and the left side of the stationary frame.

FIG. 9 illustrates another version of control assembly 444 which may be used on either side of a furniture piece, although it is shown on the left. The control assembly 444 is similar to control assemblies 44*a*, 44*b*, but has a slightly different motorized drive assembly 462. In motorized drive assembly 462, the motor 64 is vertically oriented rather than horizontally oriented. Similarly, the carriage 88 moves along one side of the shaft housing 86 rather than above or below the shaft housing 86.

While the present invention has been illustrated by the description of specific embodiments thereof, and while the embodiments have been described in considerable detail, it is not intended to restrict or in any way limit the scope of the appended claims to such detail. The various features discussed herein may be used alone or in any combination. Additional advantages and modifications will readily appear to those skilled in the art. The invention in its broader aspects is therefore not limited to the specific details, representative apparatus and methods and illustrative examples shown and described. Accordingly, departures may be made from such details without departing from the scope of the general inventive concept.

What is claimed is:

1. A motorized furniture assembly movable between a sofa position and a bed position, the motorized furniture assembly comprising:

a stationary frame having two sides;

a seat section movable relative to the stationary frame, the seat section comprising two seat deck support brackets and a seat deck extending between the seat deck support brackets, a back support section movable relative to the stationary frame, the back support section comprising back deck support brackets and a back deck extending between the back deck support brackets;

a power assembly for moving the furniture assembly between the sofa and bed positions, the power assembly comprising a power supply, a controller, at least one actuator;

two control assemblies, each control assembly including a motorized drive assembly and a linkage assembly joined to the motorized drive assembly for controlling movement of the seat and back support sections relative to the stationary frame, each of the motorized drive assemblies comprising a rotatable screw drive used to move a shuttle to move the seat and back support sections;

a universal bracket attached to each of the shuttles of each of the motorized drive assemblies, each of the universal brackets being secured to one of the seat deck support brackets such that movement of the shuttles moves the seat deck support brackets of the seat section which moves the back deck support brackets of the back support section;

two stationary mounting assemblies, one of the stationary mounting assemblies being secured to each side of the stationary frame, one of the motorized drive assemblies being mounted to each of the stationary mounting assemblies;

wherein the linkage assemblies control movement of the furniture assembly between the sofa and bed positions upon actuation of said at least one actuator, each of said linkage assemblies comprising a strong arm having a first end and a second end, the first end of the strong arm being pivotally connected to one of the seat deck support brackets and the second end of the strong arm being pivotally connected to one of the stationary mounting assemblies, and wherein movement of the shuttles of the motorized drive assemblies moves the seat section between forward and rearward positions which causes movement of the back support section between horizontal and raised positions, said linkage assembly further comprising:

a front arm having a first end and a second end, the first end of the front arm being pivotally connected to one of the stationary mounting assemblies;

an L-shaped arm having a first end and a second end, the first end of the L-shaped arm being pivotally connected to the second end of the front arm and the second end of the L-shaped arm being pivotally connected to one of the seat deck support brackets;

a connector arm having a first end and a second end, the first end of the connector arm being pivotally connected to the second end of the front arm and the first end of the L-shaped arm;

a swivel arm having an upper end and a lower end, the upper end of the swivel arm being pivotally connected to one of the stationary mounting assemblies and the lower end of the swivel arm being pivotally connected to the second end of the connector arm;

an intermediate arm having a front end and a rear end, the rear end of the intermediate arm being pivotally connected to the swivel arm between the upper and lower ends of the swivel arm;

a teeter arm having a front end and a rear end the front end of the teeter arm being pivotally connected to the front end of the intermediate arm;

a rear arm having an upper end and a lower end, the upper end of the rear arm being pivotally connected to one of the seat deck support brackets and the lower end of the rear arm being pivotally connected to the second end of the connector arm; and an outer arm having a front end and a rear end, the front end of the outer arm being pivotally connected to the rear end of the teeter arm and the rear end of the outer arm being pivotally connected to the rear arm between the upper and lower ends of the rear arm.

2. The furniture assembly of claim 1, wherein the back support section has an upper surface and a lower surface, the upper surface of the back support section being behind the lower surface of the back support section when the furniture assembly is in the sofa position.

3. The furniture assembly of claim 1, wherein the seat section has a front surface and a rear surface, the front surface of the seat section being above the rear surface of the seat section when the furniture assembly is in the sofa position.

4. The furniture assembly of claim 1, wherein each of the stationary mounting assemblies comprises a mounting piece and a motor mounting piece riveted to the mounting piece.

5. The furniture assembly of claim 4, wherein the motor mounting piece of the stationary mounting assembly is angled relative to the mounting piece of the stationary mounting assembly.

6. The furniture assembly of claim 1, wherein each of the stationary mounting assemblies comprises multiple pieces.

7. A motorized furniture assembly movable between a sofa position and a bed position, the motorized furniture assembly comprising:

a stationary frame including two sides;

a seat section movable relative to the stationary frame, the seat section comprising two seat deck support brackets and a seat deck, a back support section movable relative to the stationary frame, the back support section comprising back deck support brackets and a back deck;

a power assembly for moving the furniture assembly between the sofa and bed positions, the power assembly comprising a power supply, a controller, at least one actuator;

two motorized drive assemblies, each of the motorized drive assemblies including a movable shuttle;

a stationary mounting assembly secured to each side of the stationary frame, one of the motorized drive assemblies being mounted to the stationary mounting assembly;

a universal bracket attached to the movable shuttle, one of the seat deck support brackets being secured to the universal bracket such that the seat section moves upon movement of the shuttles of the motorized drive assemblies;

two linkage assemblies for controlling movement of the furniture assembly between the sofa and bed positions upon actuation of said at least one actuator, each of said linkage assemblies comprising:

a strong arm having a first end and a second end, the first end of the strong arm being pivotally connected to one of the seat deck support brackets and the second end of the strong arm being pivotally connected to one of the stationary mounting assemblies, a front arm having a first end and a second end, the first end of the front arm being pivotally connected to one of the stationary mounting assemblies;

an L-shaped arm having a first end and a second end, the first end of the L-shaped arm being pivotally connected to the second end of the front arm and the second end of the L-shaped arm being pivotally connected to one of the seat deck support brackets;

a connector arm having a first end and a second end, the first end of the connector arm being pivotally connected to the second end of the front arm and the first end of the L-shaped arm;

a swivel arm having an upper end and a lower end, the upper end of the swivel arm being pivotally connected to one of the stationary mounting assemblies and the lower end of the swivel arm being pivotally connected to the second end of the connector arm;

an intermediate arm having a front end and a rear end, the rear end of the intermediate arm being pivotally connected to the swivel arm between the upper and lower ends of the swivel arm;

a teeter arm having a front end and a rear end, the front end of the teeter arm being pivotally connected to the front end of the intermediate arm;

a rear arm having an upper end and a lower end, the upper end of the rear arm being pivotally connected to one of the seat deck support brackets and the lower end of the rear arm being pivotally connected to the second end of the connector arm;

an outer arm having a front end and a rear end, the front end of the outer arm being pivotally connected to the rear end of the teeter arm and the rear end of the outer arm being pivotally connected to the rear arm between the upper and lower ends of the rear arm, wherein movement of the shuttles of the motorized drive assemblies moves the seat deck support brackets and seat section between forward and rearward positions which causes movement of the back section between horizontal and raised positions.

8. The furniture assembly of claim 7, further comprising further comprising a seat deck front extending between front ends of the seat deck support brackets.

9. The furniture assembly of claim 7, wherein the moveable back section has an upper surface and a lower surface, the upper surface of the moveable back section being behind the lower surface of the moveable back section when the furniture assembly is in the sofa position.

10. The furniture assembly of claim 7, wherein the movable seat section has a front surface and a rear surface, the front surface of the seat section being above the rear surface of the seat section when the furniture assembly is in the sofa position.

11. The furniture assembly of claim 7, said at least one actuator being located on at least one side of the stationary frame.

12. The furniture assembly of claim 7, wherein the controller is secured to the stationary frame.

13. The furniture assembly of claim 7, wherein each of the stationary mounting assemblies comprises multiple pieces.

14. A kit for creating a motorized furniture assembly movable between a sofa position and a bed position, the kit comprising:

a power supply a controller;

at least one actuator;

a left hand control assembly comprising a stationary mounting assembly, a motorized drive assembly secured to the stationary mounting assembly and a left hand linkage assembly secured to the stationary mounting assembly for controlling movement of the furniture assembly between the sofa and bed positions upon actuation of said at least one actuator, a seat deck support bracket and a back deck support bracket secured to the left hand linkage assembly; and a right hand control assembly comprising a stationary mounting assembly, a motorized drive assembly secured to the stationary mounting assembly and a right hand linkage assembly secured to the stationary mounting assembly for controlling movement of the furniture assembly between the sofa and bed positions upon actuation of said at least one actuator, a seat deck support bracket and a back deck support bracket secured to the right hand linkage assembly, wherein each of said right and left hand linkage assemblies comprises:

a strong arm having a first end and a second end, the first end of the strong arm being pivotally connected to one of the seat deck support brackets and the second end of the strong arm being pivotally connected to one of the stationary mounting assemblies, a front arm having a first end and a second end, the first end of the front arm being pivotally connected to one of the stationary mounting assemblies;

an L-shaped arm having a first end and a second end, the first end of the L-shaped arm being pivotally connected to the second end of the front arm and the second end of the L-shaped arm being pivotally connected to one of the seat deck support brackets;

a connector arm having a first end and a second end, the first end of the connector arm being pivotally connected to the second end of the front arm and the first end of the L-shaped arm;

a swivel arm having an upper end and a lower end, the upper end of the swivel arm being pivotally connected to one of the stationary mounting assemblies and the lower end of the swivel arm being pivotally connected to the second end of the connector arm;

an intermediate arm having a front end and a rear end, the rear end of the intermediate arm being pivotally connected to the swivel arm between the upper and lower ends of the swivel arm;

a teeter arm having a front end and a rear end, the front end of the teeter arm being pivotally connected to the front end of the intermediate arm;

a rear arm having an upper end and a lower end, the upper end of the rear arm being pivotally connected to one of the seat deck support brackets and the lower end of the rear arm being pivotally connected to the second end of the connector arm; and an outer arm having a front end and a rear end, the front end of the outer arm being pivotally connected to the rear end of the teeter arm and the rear end of the outer arm being pivotally connected to the rear arm between the upper and lower ends of the rear arm.

15. The kit of claim 14, wherein the back deck support bracket of each control assembly is pivotally secured to the seat deck support bracket of the control assembly.

16. The kit of claim 14, wherein each of the stationary mounting assemblies comprises multiple pieces.

17. The kit of claim 14, wherein one end of the motorized drive assembly of each control assembly is secured to the stationary mounting assembly of the control assembly.

18. The kit of claim 17, wherein a movable shuttle of the motorized drive assembly is secured to the seat deck support bracket of the control assembly via a universal bracket.

* * * * *